US012692445B2

(12) United States Patent
Agee

(10) Patent No.: US 12,692,445 B2
(45) Date of Patent: Jul. 28, 2026

(54) METHOD FOR THE PRODUCTION OF LOW CARBON JET FUEL

(71) Applicant: Emerging Fuels Technology, Inc., Tulsa, OK (US)

(72) Inventor: Kenneth L. Agee, Tulsa, OK (US)

(73) Assignee: Emerging Fuels Technology, Inc., Tulsa, OK (US)

( * ) Notice: Subject to any disclaimer, the term of this patent is extended or adjusted under 35 U.S.C. 154(b) by 507 days.

(21) Appl. No.: 18/201,246

(22) Filed: May 24, 2023

(65) Prior Publication Data

US 2023/0383194 A1 Nov. 30, 2023

Related U.S. Application Data

(60) Provisional application No. 63/345,190, filed on May 24, 2022.

(51) Int. Cl.
*C10G 2/00* (2006.01)
*C10G 69/14* (2006.01)

(52) U.S. Cl.
CPC ..... *C10G 2/341* (2013.01); *C10G 2/332* (2013.01); *C10G 69/14* (2013.01);
(Continued)

(58) Field of Classification Search
CPC ..... C10G 2/341; C10G 2/332; C10G 69/14; C10G 2300/1022; C10G 2300/4081;
(Continued)

(56) References Cited

U.S. PATENT DOCUMENTS 4,456,527 A 6/1984 Buss et al.
5,894,076 A 4/1999 Hearn et al.
(Continued)

FOREIGN PATENT DOCUMENTS

WO 2003066777 8/2003
WO 2006-056594 6/2006

OTHER PUBLICATIONS

International Search Report and Written Opinion International PCT Application No. PCT/US23/023329, Korean Intellectual Property Office, Sep. 20, 2023.
(Continued)

*Primary Examiner* — Jafar F Parsa
(74) *Attorney, Agent, or Firm* — Head, Johnson, Kachigian & Wilkinson, PC

(57) ABSTRACT

A method to produce a fuel product such as jet fuel, diesel, or single battlefield fuel from a Fischer Tropsch syncrude comprising the steps of: 1) generation of synthesis gas; 2) conversion of synthesis gas to hydrocarbon products by the Fischer Tropsch reaction; 3) upgrading raw Fischer Tropsch products by hydrocracking and hydroisomerization; 4) converting a portion of the Fischer Tropsch naphtha into aromatic hydrocarbons by dehydrocyclization; 5) hydrogenating CO2 from steps 1 and 2 to make olefinic hydrocarbon products; 6) alkylating aromatics from step 4 with olefins from step 5; and 7) combining the paraffin and iso-paraffin products from step 3 with alkylated aromatics from step 6 and distilling to make a low carbon distillate fuel. The method can be modified to make a single fuel product, preferably a jet fuel product.

11 Claims, 1 Drawing Sheet

(52) U.S. Cl.
CPC ..... *C10G 2300/1022* (2013.01); *C10G 2300/4081* (2013.01); *C10G 2400/08* (2013.01)

(58) Field of Classification Search
CPC ..... C10G 2400/08; C10G 2/30; C10G 2/32; C10G 47/00
See application file for complete search history.

(56) References Cited

U.S. PATENT DOCUMENTS

| | | | |
|---|---|---|---|
| 6,309,432 | B1 | 10/2001 | Wittenbrink et al. |
| 6,890,423 | B2 | 5/2005 | O'Rear |
| 9,879,192 | B2 | 1/2018 | Watermeyer De Wet et al. |
| 10,011,789 | B2 | 7/2018 | De Klerk |
| 2002/0128332 | A1 | 9/2002 | O'Rear et al. |
| 2003/0085153 | A1 | 5/2003 | O'Rear |
| 2004/0181110 | A1 | 9/2004 | Miller et al. |
| 2010/0298451 | A1 | 11/2010 | Dandeu et al. |
| 2011/0105811 | A1 | 5/2011 | O'Rear et al. |
| 2011/0309000 | A1 | 12/2011 | Tanaka et al. |
| 2012/0209037 | A1 | 8/2012 | Viljoen et al. |
| 2014/0206915 | A1* | 7/2014 | Chen ..... C10L 1/08 585/254 |
| 2016/0046869 | A1 | 2/2016 | Ishito et al. |
| 2018/0291279 | A1 | 10/2018 | Jack et al. |
| 2023/0108520 | A1 | 4/2023 | Agee et al. |

OTHER PUBLICATIONS

International Search Report and Written Opinion International PCT Application No. PCT/US22/45525, Korean Intellectual Property Office, Jan. 25, 2023.

* cited by examiner

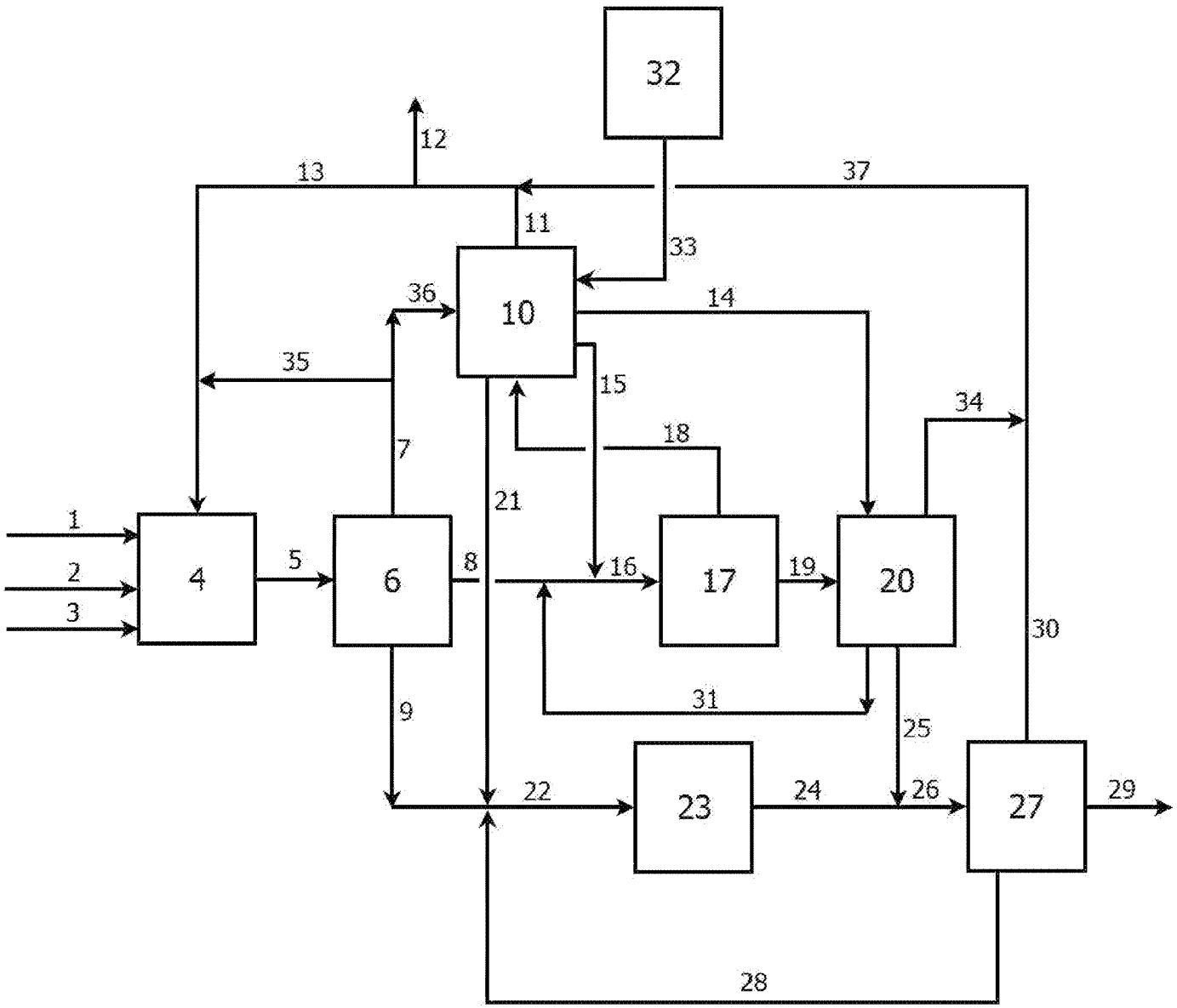
1
2
3
4
5
6
7
8
9
10
11
12
13
14
15
16
17
18
19
20
21
22
23
24
25
26
27
28
29
30
31
32
33
34
35
36
37

METHOD FOR THE PRODUCTION OF LOW CARBON JET FUEL

CROSS REFERENCE

This application is based on and claims priority to U.S. Provisional Patent Application No. 63/345,190 filed May 24, 2022.

BACKGROUND OF THE INVENTION

Field of the Invention

This invention relates generally to a method for producing synthetic fuel products, particularly a low carbon synthetic jet fuel product. More particularly, this invention relates to a method for producing low carbon synthetic distillate fuels from a Fischer Tropsch syncrude.

Description of the Related Art

Fischer Tropsch syncrude, preferably syncrude made by a non-shifting Fischer Tropsch catalyst, comprises predominately normal paraffins (n-paraffins), also referred to as straight chain hydrocarbons with very low levels of sulfur, nitrogen, or aromatics. Additionally, the lighter fractions of the Fischer Tropsch syncrude contain small amounts of alcohols and olefins. While the linear paraffinic nature of the Fischer Tropsch syncrude is advantageous for some properties of synthetic distillate fuels, such as cetane and smoke point, these paraffinic molecules are disadvantageous for cold flow properties such as freeze point and pour point. Thus, the syncrude must be further processed by hydrocracking and hydroisomerizaion to produce a substantial amount of iso-paraffin content, which greatly improves the cold flow properties of the final product. These Fischer Tropsch fuels are somewhat disadvantaged due to low density and total absence of aromatics or cycloparaffins, which have a positive effect on swelling of certain materials used in seals for some engines.

Based on the foregoing, it is desirable to provide an efficient method to produce a synthetic fuel product, particularly a low carbon fuel such as a jet fuel or a diesel fuel, in high yields with a high iso to n-paraffin ratio and a minor amount of aromatics or cycloparaffins that increase the density and improve seal swell properties of the final fuel product.

SUMMARY OF THE INVENTION

In general, in a first aspect, the invention relates to a method designed to produce high yields of a low carbon intensity jet fuel product. Variations of the method can be used to produce other fuel products such as diesel or a single battlefield fuel.

There is increasing interest in developing methods to produce a clean jet fuel product from non-petroleum sources. Such sources can be processed in a way that results in a large reduction of greenhouse gas (GHG) emissions and the resulting fuel will burn cleaner than the petroleum derived version. Synthetic jet fuel made with renewable feeds may also be referred to as Sustainable Aviation Fuel or SAF. One way to produce these fuel products is via the Fischer Tropsch process. The Fischer Tropsch reaction requires a feed gas comprising carbon monoxide and hydrogen, also known as synthesis gas, to make synthetic hydrocarbon products. Synthesis gas can be made by steam reforming, autothermal reforming or partial oxidation of many different starting materials, such as natural gas, coal seam gas, or biogas, or it can be made by gasification or pyrolysis of a solid carbonaceous feed material. Synthesis gas can be made by converting CO2 via electrolysis or reverse shift to carbon monoxide and hydrogen can be made by electrolysis of water. The degree of GHG reduction associated with the production and use of the fuel product varies depending on the feedstock and how it is processed. Natural gas from a pipeline as a feedstock does not result in a large GHG reduction. However, gas that is being flared is completely different. Natural gas flaring is a global problem and one of the largest sources of GHG emissions in the world. Approximately 15 billion cubic feet per day of natural gas is currently being flared. At best these flares oxidize the methane to CO2 and vent it to the atmosphere with no useful product or energy recovery. A typical flare, however, is not 100% efficient. Recent studies have shown that in addition to producing large amounts of polluting carbon particulates the typical flare is distorted by wind, which drives the flame away from the flare tip and reduces flare efficiency. Therefore, a typical flare releases an average of 2% to 5% of the methane that is unburned. Methane is at least 25 times more potent as a greenhouse gas than CO2 and therefore the GHG equivalent of the methane slip may be greater than the CO2 released from combustion.

Synthesis gas can also be produced from pyrolysis or gasification of biomass. Biogas and biomass are considered renewable resources as they comprise carbon that was pulled out of the atmosphere by photosynthesis. When this carbon is incorporated into a fuel and the fuel is combusted, it goes back to the atmosphere resulting in a carbon neutral sustainable cycle. Another source of carbon for synthesis gas is CO2, which can either be extracted from the atmosphere or from a smokestack. This CO2 can be converted to CO by a reverse shift reaction or by modified electrolysis, or CO2 can be directly hydrogenated to make hydrocarbons. Water can be split by electrolysis into hydrogen and oxygen. Any of these sources of CO and H2 can be used as feed to a Fischer Tropsch reactor to produce a hydrocarbon product that can be upgraded to fuel products such as jet fuel, diesel, or single battlefield fuel, by the method of the present invention. Sources that reduce GHG emissions may be preferred.

Many methods can be used to generate synthesis gas as described above. The objective of these methods is to generate carbon monoxide and hydrogen in the desired portions for the Fischer Tropsch reaction. In many such methods, a substantial portion of carbon may exit the synthesis gas generation system as carbon dioxide. It is an objective of the present invention to hydrogenate a portion of that carbon dioxide to make more hydrocarbons and thus reduce the carbon intensity of the method and increase yields of useable products. This may include CO2 in the feed where CO2 may be the primary feed or the feed may be a biogas for example from a landfill or anaerobic digester which may contain substantial CO2. It is a further objective of the present invention to provide a method to efficiently convert Fischer Tropsch hydrocarbons into finished fuel products such as jet fuel or diesel fuel of increased density and aromatic or cycloparaffin content compared to a cracked paraffin Fischer Tropsch product. This method can be used to make fuel products that are totally compatible with existing infrastructure, such as jet engines and diesel engines. Jet fuel and diesel fuel products of the present invention can be made in a way that results in a large reduction in GHG emissions.

A fuel product as defined herein may be a liquid hydrocarbon fuel such as jet fuel, diesel, or single battlefield fuel or any other liquid hydrocarbon fuel product designed to meet a fuel specification for use in a turbine or internal combustion engine. The target fuels may be considered distillate fuels. Naphtha is considered to be a gasoline blending component and generally of lower carbon number compared to the target fuels of the method. The Fischer Tropsch reaction produces a broad range of hydrocarbon products including naphtha. Naphtha in the method may be used to enhance yields and properties of the desired distillate products. It is an objective of the present invention to convert most or all of the naphtha into distillate fuel components that blend into the final product, thus minimizing the yield of any naphtha as a product.

The Fischer Tropsch catalyst of the method is preferably a non-shifting Cobalt catalyst. In a preferred embodiment, the cobalt catalyst may produce tail gas and a heavy waxy syncrude. This syncrude product may typically be produced in at least two liquid fractions, referred to herein as LFTL (Light Fischer Tropsch Liquid) and HFTL (Heavy Fischer Tropsch Liquid). The HFTL product may be separated from the LFTL product and maintained at elevated temperature to keep waxes contained therein in liquid form. The temperature required to keep the HFTL product liquid will also volatilize portions of the LFTL product, so once produced, they may be kept separate until required for further processing or blending. The HFTL product may contain mostly n-paraffin molecules with small amounts of olefins and alcohols. The LFTL product may be also mostly made of n-paraffins and may also contain a small amount of olefins and alcohols.

The present invention may provide a method to take advantage of the unique qualities of the Fischer Tropsch syncrude fractions and to maximize the yield and quality of products such as jet fuel. A preferred embodiment may produce maximum jet fuel yield even as high as 100%. The preferred method may comprise seven key steps: 1) generation of synthesis gas; 2) conversion of synthesis gas to hydrocarbon products by the Fischer Tropsch reaction; 3) upgrading raw Fischer Tropsch products by hydrocracking and hydroisomerization; 4) converting a portion of the Fischer Tropsch naphtha into aromatic hydrocarbons by dehydrocyclization; 5) hydrogenating CO2 from steps 1 and 2 (including CO2 that may be in the feed) to make olefinic hydrocarbon products; 6) alkylating aromatics from step 4 with olefins from step 5; and 7) combining the paraffin and iso-paraffin products from step 3 with alkylated aromatics from step 6 and distilling to make a low carbon distillate fuel product.

U.S. Pat. No. 6,890,423 teaches the production of a fully synthetic jet fuel produced from a Fischer Tropsch feedstock. The seal swell and lubricity characteristics of the base Fischer Tropsch distillate fuel are adjusted through the addition of alkylaromatics and alkylcycloparaffins that are produced via the catalytic reforming of Fischer Tropsch naphtha product. The process can result in a suitable on-specification jet fuel product generated entirely from a non-petroleum source. However, the process does not utilize waste CO2 that can enhance yields and provide the light olefins needed to alkylate the aromatic products while reducing the carbon intensity of the final product, which is provided by the present invention

BRIEF DESCRIPTION OF THE DRAWINGS

FIG. 1 is a simplified process flow diagram showing the major components of a method according to the present invention.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to an integrated method to make a high quality fuel product such as a middle distillate fuel, particularly jet fuel. In the method, residual CO2 from syngas generation and to a lesser degree from the FT reaction, or the feed, is hydrogenated to make additional hydrocarbon products including light olefins that can be incorporated into the final distillate product by alkylation with aromatics produced by dehydrocyclization of FT naphtha products. The combined steps of the invention improve the carbon intensity of the method and move lighter products into the target distillate fuel, improving the yield and quality of the target product. Target products of the invention include jet fuel, diesel, and single battlefield fuel.

The method of the present invention may comprise seven steps. In the preferred embodiment, the method may produce neat jet fuel. Specifically, the preferred method may comprise seven key steps: 1) generation of synthesis gas; 2) conversion of synthesis gas to hydrocarbon products by the Fischer Tropsch reaction; 3) upgrading raw Fischer Tropsch products by hydrocracking and hydroisomerization; 4) converting a portion of the Fischer Tropsch naphtha into aromatic hydrocarbons by dehydrocyclization; 5) hydrogenating CO2 from steps 1 and 2 to make olefinic hydrocarbon products; 6) alkylating aromatics from step 4 with olefins from step 5; and 7) combining the paraffin and iso-paraffin products from step 3 with alkylated aromatics from step 6 and distilling to make a low carbon distillate fuel product.

The method of the present invention may be used to upgrade synthetic crude derived by a Fischer Tropsch process, preferably comprising a non-shifting low temperature Cobalt catalyst. Any type of Fischer Tropsch reactor known to one skilled in the art may be used. A preferred reactor is a tubular fixed bed Fischer Tropsch reactor.

The seven steps of the method are described in more detail:

Step 1. Synthesis gas generation may vary with the characteristics of the feed material. For a gaseous feedstock, the syngas generation method may comprise a steam methane reformer (SMR) or partial oxidation or an autothermal reformer. If the gas comprises heavier hydrocarbons such as C2+, it may be desirable to use a pre-reformer to reduce the chance of soot production. Solid feeds may be processed with a pyrolysis reactor or a gasification reactor. Many variations of these systems exist, each with benefits and drawbacks. Any method to make synthesis gas known to one skilled in the art may be used. The feedstock may also be CO2 from a point source such as an industrial smokestack or it can be recovered from the atmosphere, referred to as direct air capture. When CO2 is the feed, it may be converted to carbon monoxide by reverse shift or by electrolysis. Hydrogen may be provided by electrolysis of water, making byproduct oxygen, which may be used for reacting with recycled tail gas to convert light hydrocarbons to make additional synthesis gas, and residual CO2 may be upgraded by the method described herein. With respect to the present invention, the method of making synthesis gas is not critical. Any method or combination of methods may be used.

Step 2. Synthesis gas is converted to heavier C2+ hydrocarbon products by a Fischer Tropsch reaction. The preferred Fischer Tropsch catalyst is a non-shifting Cobalt Fischer catalyst. The Fischer Tropsch reactor may be any type of reactor known to one skilled in the art, preferably a fixed bed tubular reactor.

Step 3. Raw Fischer Tropsch products produced by a non-shifting cobalt catalyst are characteristically very linear, comprising mostly n-paraffin molecules, with minor amounts of olefins and alcohols. The Fischer Tropsch reaction produces a broad range of product in the naphtha, distillate, and wax range, defined herein as C5-C9, C10-C20 and C21+ respectively. The exact carbon number is not critical as different products and different process configurations may lead to separating the product in slightly different ways. The waxy products are too heavy for all distillate products and must be cracked to reduce the boiling point range. A preferred method for this step is to crack the waxy portion of the Fischer Tropsch product in a stacked bed reactor comprising both cracking catalyst and isomerization catalyst as described in U.S. patent application Ser. No. 17/492,324, such method comprising an enhanced separator controls the portion of the product that goes through the stacked bed reactor. In the present invention, this separator may also be important as the naphtha portion of the product is further processed and control of the carbon distribution of that product is important as well.

Step 4). Light hydrocarbons in the naphtha range, preferably C5-C9 or C6-C9, or C6-C8, may be converted to aromatic hydrocarbons by dehydrocyclization.

Step 5). Hydrogenate CO2 to make additional hydrocarbon products. Synthesis gas generation methods are designed to make carbon monoxide and hydrogen. Regardless which method is used there is almost always some residual carbon in the form of CO2, especially if the feed is CO2 or contains substantial CO2 such as landfill gas or anaerobic digester gas. Additionally, the non-shifting cobalt Fischer Tropsch catalyst may produce a small amount of CO2. If the Fischer Tropsch tail gas is recycled to the synthesis gas generation system, this CO2 can build up and needs to be purged. This step can be used to reduce this CO2 build up by hydrogenating the CO2 to hydrocarbon products. Preferably, the CO2 hydrogenation catalyst and operating conditions may be optimized to make a substantial portion of the hydrocarbons in the C2-C10 range. Such light hydrocarbons are rich in olefins, which can be used in the method to increase yields and quality of desired products.

Step 6). Aromatic hydrocarbons from step 4 may be alkylated with light olefins from step 5, yielding alkylaromatics that are in the jet or diesel range. This step provides several benefits to the method such as:

1) Carbon is added to the product from CO2 increasing product yield and reducing the carbon intensity of the method;
2) Light olefins from CO2 hydrogenation are added to the aromatics from dehydrocyclization of naphtha range hydrocarbons, moving these products up into the distillate range improving yields of the desired target products and reducing yield of the less desirable naphtha product;
3) Aromatic hydrocarbons can be hydrogenated to make cycloparaffins. Both aromatic hydrocarbons and cycloparaffin hydrocarbons improve the seal swell characteristics of the distillate product. This is especially important for a jet fuel product;
4) Aromatic and cycloparaffin hydrocarbons have a higher density than the isoparaffin hydrocarbons. Isoparaffinic hydrocarbons can be blended into jet fuel up to 50%. If the density and aromatic content of the Fischer Tropsch derived jet fuel is increased enough it may be possible to use the jet fuel described herein as a neat fuel.

Step 7). The isoparaffinic product of step 3 may be blended with the cyclic products (aromatics or cycloparaffins) of step 6 and distilled to meet the boiling point requirement of the target product which may be a jet fuel, diesel, or single battlefield fuel.

Referring to FIG. 1, feed 1 comprising carbon and hydrogen may be processed in syngas generation unit (4) to make synthesis gas. The feed (1) can be anything comprising carbon and hydrogen like natural gas, biogas, coal seam gas, landfill gas, CO2 and water or solids such as biomass or coal. Preferred feeds include biogas and biomass. The synthesis gas generation system may be comprised of any method known to one skilled in the art such as steam methane reforming, partial oxidation, autothermal reforming, gasification, and pyrolysis. For most methods, additional reactants may include oxygen (2), which may include air or enriched air and water or steam (3). Synthesis gas (5) may be adjusted to meet the requirements of the Fischer Tropsch system. This may include compression and clean-up for removal of contaminants such as sulfur, nitrogen compounds, halogens, or metals and adjustment of the H2:CO ratio. Adjusted, clean synthesis gas at the desired pressure may be fed to the Fischer Tropsch system (6), which may comprise a Fischer Tropsch reactor and a Fischer Tropsch catalyst and my also include separators and optionally a recycle compressor and may include coolers, preheaters, and a steam system for cooling the reactor. Any type of Fischer Tropsch reactor known to one skilled in the art may be used, but a fixed bed tubular reactor is preferred.

Fischer Tropsch products may be separated inside the Fischer Tropsch system (6) including Fischer Tropsch tail gas (7) comprising hydrocarbons C5 and lighter, unreacted CO and H2, CO2 from synthesis gas generator (4), and any CO2 made by the Fischer Tropsch catalyst. The cut point is not critical as some C5 in the naphtha range product can go to the dehydrocyclization system (17). In the preferred embodiment, the Fischer Tropsch tail gas contains much of the C5. This tail gas can be recycled (35) to the synthesis gas generation system (4) where some of the CO2 can reverse shift, thus improving yields of CO for the Fischer Tropsch reaction. This recycle is limited as CO2 will build up in the system if it is not removed. Tail gas that is not recycled (36) may contain CO2 that represents a loss of carbon from the system. This CO2 may be further utilized in CO2 hydrogenation unit (10) where a portion of the CO2 may be converted to CO and light hydrocarbons such as methane, which exits the CO2 hydrogenation unit via line (11) and can be purged as fuel (12) or can be recycled (13) to the syngas generation system (4). Hydrogen (18) may be added to the CO2 hydrogenation unit from the dehydrocyclization unit (17) via line (18) or from H2 generator (32) via line (33). In addition to producing CO and light hydrocarbon gases, the CO2 hydrogenation unit may also generate hydrocarbons rich in olefins. The unit is preferably operated to maximize production of light olefins in the C2-C10 range. Such light olefins (14) may be used to alkylate aromatics produced in the dehydrocyclization unit, in alkylation unit (20).

Optionally a portion of the Naphtha range olefins (15) generated in the CO2 hydrogenation unit may be saturated before blending with light Fischer Tropsch product (8). Naphtha product (8) exiting the Fischer Tropsch system may be preferably a narrow cut that will limit the yield of aromatics in dehydrocyclization unit (17). Unreacted paraffins and light aromatics that are too light for the target product may be recycled to the dehydrocylization unit by blending streams (8), (15), and (31). The combined naphtha stream (16) may make up the total feed to dehydrocyclization unit (17). Aromatic containing product (19) may be further alkylated with light olefins (14) in alkylation unit (20). These alkylated aromatics (25) may be blended with isoparaffinic product (24). The combined stream (26) may be further distilled into the final product (29). Alternatively, the alkylated aromatics (25) may be hydrogenated to produce cycloparaffins and then blended with the isoparaffinic product where the combined stream (26) is distilled into the final product (29). In a limited embodiment, cycloparaffins produced by the method could be used as a rocket fuel with the addition of little or no isoparaffins from hydroprocessing unit (23).

Most of the C10+ Fischer Tropsch product (9) may be converted to a mixture of isoparaffins and cracked products in hydroprocessing unit (23) where cracking and isomerization reactions convert heavy products into the desired carbon range for the target product. In addition to the C10+ Fischer Tropsch hydrocarbons, heavy olefins (21) from CO2 hydrogenation system (10), which may alternatively be saturated before mixing with C10+ product (9) from the Fischer Tropsch system and heavy product beyond the target product endpoint (28), may be mixed as stream (22), which may be fed to the hydrocracker/isomerization unit (23). The product (24) of unit (23) may be mixed with alkylated aromatics and/or cycloparaffins (25) and fed to distillation column (27) where the final product (29) is distilled. Light hydrocarbon product from distillation (30) and from alkylation (34) may be removed and the combined stream (37) may be added to the CO2 hydrogenation residue gas (11), which may be purged as fuel (12) or recycled to syngas generation (13).

Whereas, the devices and methods have been described in relation to the drawings and claims, it should be understood that other and further modifications, apart from those shown or suggested herein, may be made within the spirit and scope of this invention.

What is claimed is:

1. A method to produce a fuel product from a Fischer Tropsch syncrude, the method comprising the steps of:

a) generating synthesis gas comprising carbon monoxide and hydrogen;

b) reacting the synthesis gas from step (a) in a Fischer Tropsch reactor to produce a Fischer Tropsch product;

c) reacting a portion of the Fischer Tropsch product in a stacked bed reactor with cracking catalyst and isomerization catalyst to produce cracked isoparaffinic product and naphtha range products;

d) converting the naphtha range products to an aromatics rich product by dehydrocyclization;

e) hydrogenating CO2 from step (a) and (b) to make hydrocarbons rich in olefins;

f) alkylating the aromatics of step (d) with light olefins of step (e) to produce alkylated aromatics; and g) blending the cracked isoparaffinic product from step (c) with the alkylated aromatics from step (f) and distilling into a final distillate product.

2. The method of claim 1 wherein the Fischer Tropsch reactor comprises a Fischer Tropsch catalyst and where the Fischer Tropsch catalyst is a non-shifting Cobalt containing catalyst.

3. The method of claim 1 wherein the Fischer Tropsch reactor is a fixed bed tubular reactor.

4. The method of claim 1 wherein the fuel product is jet fuel, diesel, a single battlefield fuel.

5. The method of claim 1 wherein the fuel product has an iso to n-paraffin ratio of greater than 4:1.

6. The method of claim 1 wherein the stacked bed reactor has the cracking catalyst as a top layer and the isomerization catalyst as a bottom layer.

7. The method of claim 1 wherein the cracking catalyst and the isomerization catalyst comprise Platinum or Palladium or combinations thereof on alumina, silica, silica/alumina, or zeolite.

8. The method of claim 1 wherein the ratio of the cracking catalyst to isomerization catalyst is from 0.1:1 to 99:1.

9. The method of claim 1 wherein step (a) utilizes feed gas, where the feed gas is CO2 or comprises CO2.

10. The method of claim 1 wherein step (a) comprises a steam methane reformer, partial oxidation reactor, autothermal reformer, reverse water gas shift reactor, electrolysis, gasification, pyrolysis, or any method known to one skilled in the art to generate synthesis gas.

11. The method of claim 1 wherein alkylated aromatics are hydrogenated to make cycloparaffins to which are added no or a small amount of isoparaffins from step 1(c) which can be used as a rocket fuel.

* * * * *